US008839627B2

(12) United States Patent
Eastwood et al.

(10) Patent No.: US 8,839,627 B2
(45) Date of Patent: Sep. 23, 2014

(54) ANNULAR COMBUSTOR

(75) Inventors: Jonathan Jeffery Eastwood, Newington, CT (US); Joey Wong, Enfield, CT (US); Robert M. Sonntag, Bolton, CT (US)

(73) Assignee: United Technologies Corporation, Hartford, CT (US)

( * ) Notice: Subject to any disclaimer, the term of this patent is extended or adjusted under 35 U.S.C. 154(b) by 418 days.

(21) Appl. No.: 13/399,442

(22) Filed: Feb. 17, 2012

(65) Prior Publication Data

US 2013/0192262 A1 Aug. 1, 2013

Related U.S. Application Data

(60) Provisional application No. 61/592,767, filed on Jan. 31, 2012.

(51) Int. Cl.
*F02C 1/00* (2006.01)
*F02G 3/00* (2006.01)

(52) U.S. Cl.
USPC ..... 60/752; 60/753; 60/754; 60/755; 60/756; 60/757; 60/758; 60/759; 60/760; 60/804

(58) Field of Classification Search
USPC ..... 60/752–760, 804
See application file for complete search history.

(56) References Cited

U.S. PATENT DOCUMENTS

| | | | | |
|---|---|---|---|---|
| 4,686,823 | A | 8/1987 | Coburn et al. | |
| 5,253,471 | A | 10/1993 | Richardson | |
| 5,329,761 | A * | 7/1994 | Ablett et al. | 60/804 |
| 5,799,491 | A | 9/1998 | Bell et al. | |
| 6,412,272 | B1 | 7/2002 | Titterton, III et al. | |
| 6,978,618 | B2 * | 12/2005 | Pacheco-Tougas et al. | 60/752 |
| 7,093,439 | B2 | 8/2006 | Pacheco-Tougas et al. | |
| 7,121,095 | B2 | 10/2006 | McMasters et al. | |
| 7,694,505 | B2 | 4/2010 | Schilling | |
| 7,954,325 | B2 | 6/2011 | Burd et al. | |
| 8,037,691 | B2 * | 10/2011 | Commaret et al. | 60/756 |
| 2007/0082530 | A1 | 4/2007 | Burd | |
| 2011/0126543 | A1 | 6/2011 | Kirsopp et al. | |

OTHER PUBLICATIONS

Gunston: "Jane's Aero-Engines," PRATT & WHITNEY/USA, Mar. 2000, JAEng—Issue 7, Copyright 2000 by Jane's Information Group Limited, pp. 510-512.

International Search Report and Written Opinion for International Application No. PCT/US2013/021409 completed on Sep. 11, 2013.

* cited by examiner

*Primary Examiner* — Craig Kim

(74) *Attorney, Agent, or Firm* — Carlson, Gaskey & Olds, P.C.

(57) ABSTRACT

An annular combustor includes an annular outer shell that includes a first flange that defines an inner diameter $ID_{OS}$ and an annular inner shell that includes a second flange that defines an outer diameter $OD_{IS}$. An annular hood includes a radially outer hood flange and a radially inner hood flange. A bulkhead includes a radially outer bulkhead flange that defines an outer diameter $OD_B$ and a radially inner bulkhead flange that defines an inner diameter $ID_B$. The first flange is secured at a radially outer joint between the radially outer hood flange and the radially outer bulkhead flange. The second flange is secured at a radially inner joint between the radially inner hood flange and the radially inner bulkhead flange. The $ID_{OS}$ and the $OD_B$ define a ratio R1 of $ID_{OS}/OD_B$ that is 0.998622-1.001129, and the $ID_B$ and the $OD_{IS}$ define a ratio R2 of $ID_B/OD_{IS}$ that is 0.998812-1.001388.

11 Claims, 4 Drawing Sheets

ANNULAR COMBUSTOR

CROSS-REFERENCE TO RELATED APPLICATION

This application claims priority to U.S. Provisional Application Ser. No. 61/592,767, filed on Jan. 31, 2012.

BACKGROUND

This disclosure relates to annular combustors and, more particularly, to joints at which various components of the annular combustor are secured together.

Annular combustors, such as those used in gas turbine engines, typically include radially spaced inner and outer liners that define an annular combustion chamber there between. Each of the inner and outer liners includes a respective flange that is secured with a corresponding flange on a bulkhead of the combustor. To facilitate assembly of the liners to the bulkhead, the liners and bulkhead are designed with a relatively loose fit between the flanges. The flanges at the respective joints are then joined together using a fastener.

SUMMARY

An annular combustor according to an exemplary aspect of the present disclosure comprises an annular outer shell that includes a first flange defining an inner diameter $ID_{OS}$, an annular inner shell radially spaced from the annular outer shell to define an annular combustion chamber there between. The annular inner shell includes a second flange defining an outer diameter $OD_{IS}$. An annular hood includes a radially outer hood flange and a radially inner hood flange. A bulkhead divides the annular combustion chamber and the annular hood. The bulkhead includes a radially outer bulkhead flange defining an outer diameter $OD_B$ and a radially inner bulkhead flange defining an inner diameter $ID_B$. The first flange is secured in a radially outer joint between the radially outer hood flange and the radially outer bulkhead flange. The second flange is secured in a radially inner joint between the radially inner hood flange and the radially inner bulkhead flange. The $ID_{OS}$ and the $OD_B$ define a ratio R1 of $ID_{OS}/OD_B$ that is 0.998622-1.001129, and the $ID_B$ and the $OD_{IS}$ define a ratio R2 of $ID_B/OD_{IS}$ that is 0.998812-1.001388.

A further non-limiting embodiment includes an interference fit between the radially outer hood flange and the first flange.

A further non-limiting embodiment of any of the foregoing examples includes an interference fit between the radially inner hood flange and the second flange.

In a further non-limiting embodiment of any of the foregoing examples, R1 is 0.998675-1.001085.

In a further non-limiting embodiment of any of the foregoing examples, R1 is 0.999177-1.000875.

In a further non-limiting embodiment of any of the foregoing examples, R2 is 0.0.998859-1.001334.

In a further non-limiting embodiment of any of the foregoing examples, R2 is 0.99892-1.000927.

A turbine engine according to an exemplary aspect of the present disclosure includes a compressor section, an annular combustor in fluid communication with the compressor section, and a turbine section in fluid communication with the annular combustor. The annular combustor is as described in any of the foregoing examples.

A method of controlling leakage in an annular combustor according to an exemplary aspect of the present disclosure includes providing an annular outer shell including a first flange defining an inner diameter $ID_{OS}$, providing an annular inner shell radially spaced from the annular outer shell to define an annular combustion chamber there between, the annular inner shell including a second flange defining an outer diameter $OD_{IS}$, providing an annular hood including a radially outer hood flange and a radially inner hood flange, and providing a bulkhead dividing the annular combustion chamber and the annular hood. The bulkhead includes a radially outer bulkhead flange defining an outer diameter $OD_B$ and a radially inner bulkhead flange defining an inner diameter $ID_B$. The first flange is secured at a radially outer joint between the radially outer hood flange and the radially outer bulkhead flange with the $ID_{OS}$ and the $OD_B$ defining a ratio R1 of $ID_{OS}/OD_B$ that is 0.998622-1.001129 to control leakage of gas through the radially outer joint. The second flange is secured at a radially inner joint between the radially inner hood flange and the radially inner bulkhead flange with the $ID_B$ and the $OD_{IS}$ defining a ratio R2 of $ID_B/OD_{IS}$ that is 0.998812-1.001388 to control leakage of gas through the radially inner joint.

A further non-limiting embodiment of the foregoing example includes heating at least one of the annular outer shell, the annular inner shell and the bulkhead at a temperature of at least 240° F./116° C.

A further non-limiting embodiment of any of the foregoing examples includes heating the annular outer shell at a temperature of 240° F./116° C., cooling the annular inner shell at a temperature of −275° F./−171° C., and heating the bulkhead at a temperature of 350° F./177° C.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
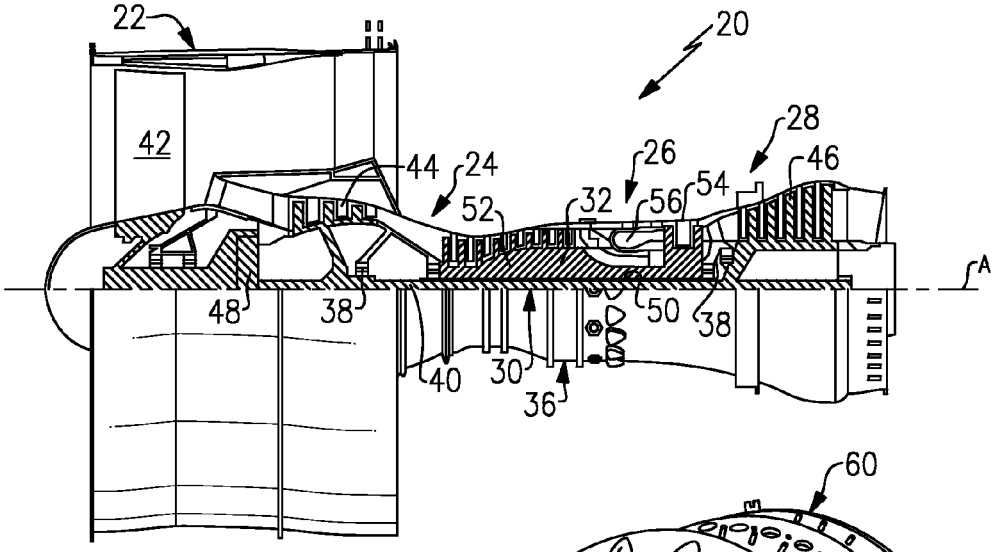
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a first spool 30 and a second spool 32 mounted for rotation about an engine central axis A relative to an engine static structure 36 via several bearing systems 38. It should be understood that various bearing systems 38 at various locations may alternatively or additionally be provided.

The first spool 30 generally includes a first shaft 40 that interconnects a fan 42, a first compressor 44 and a first turbine 46. The first shaft 40 is connected to the fan 42 through a gear assembly of a fan drive gear system 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. An annular combustor 56 is arranged between the second compressor 52 and the second turbine 54. The first shaft 40 and the second shaft 50 are concentric and rotate via bearing systems 38 about the engine central axis A which is collinear with their longitudinal axes.

The core airflow is compressed by the first compressor 44 then the second compressor 52, mixed and burned with fuel in the annular combustor 56, then expanded over the second turbine 54 and first turbine 46. The first turbine 46 and the second turbine 54 rotationally drive, respectively, the first spool 30 and the second spool 32 in response to the expansion.

The engine 20 is a high-bypass geared aircraft engine that has a bypass ratio that is greater than about six (6), with an example embodiment being greater than ten (10), the gear assembly of the fan drive gear system 48 is an epicyclic gear train, such as a planetary gear system or other gear system, with a gear reduction ratio of greater than about 2.3:1 and the first turbine 46 has a pressure ratio that is greater than about 5. The first turbine 46 pressure ratio is pressure measured prior to inlet of first turbine 46 as related to the pressure at the outlet of the first turbine 46 prior to an exhaust nozzle. The first turbine 46 has a maximum rotor diameter and the fan 42 has a fan diameter such that a ratio of the maximum rotor diameter divided by the fan diameter is less than 0.6. It should be understood, however, that the above parameters are only exemplary.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 feet, with the engine at its best fuel consumption. To make an accurate comparison of fuel consumption between engines, fuel consumption is reduced to a common denominator, which is applicable to all types and sizes of turbojets and turbofans. The term is thrust specific fuel consumption, or TSFC. This is an engine's fuel consumption in pounds per hour divided by the net thrust. The result is the amount of fuel required to produce one pound of thrust. The TSFC unit is pounds per hour per pounds of thrust (lb/hr/lb Fn). When it is obvious that the reference is to a turbojet or turbofan engine, TSFC is often simply called specific fuel consumption, or SFC. "Low fan pressure ratio" is the pressure ratio across the fan blade alone, without a Fan Exit Guide Vane system. The low fan pressure ratio as disclosed herein according to one non-limiting embodiment is less than about 1.45. "Low corrected fan tip speed" is the actual fan tip speed in feet per second divided by an industry standard temperature correction of [(Tambient degree Rankine)/518.7)^0.5]. The "Low corrected fan tip speed" as disclosed herein according to one non-limiting embodiment is less than about 1150 feet per second.

Figure 2A:
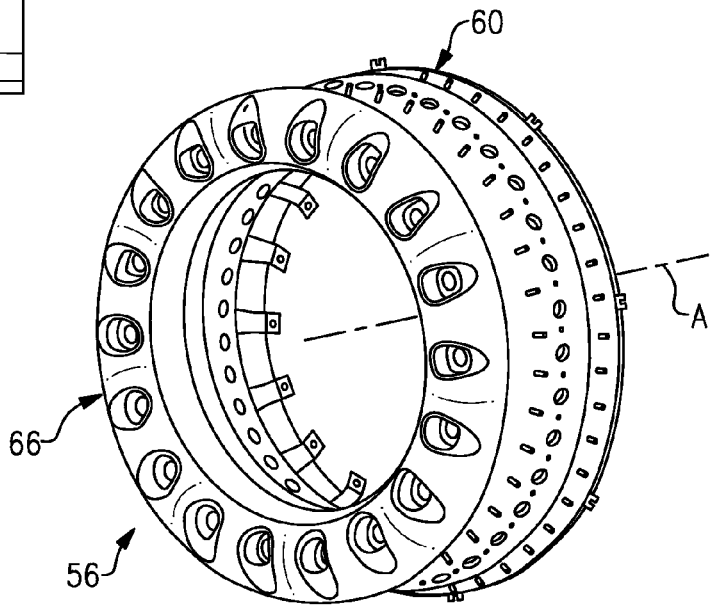
FIG. 2A illustrates a perspective view of an annular combustor.
Figure 2B:
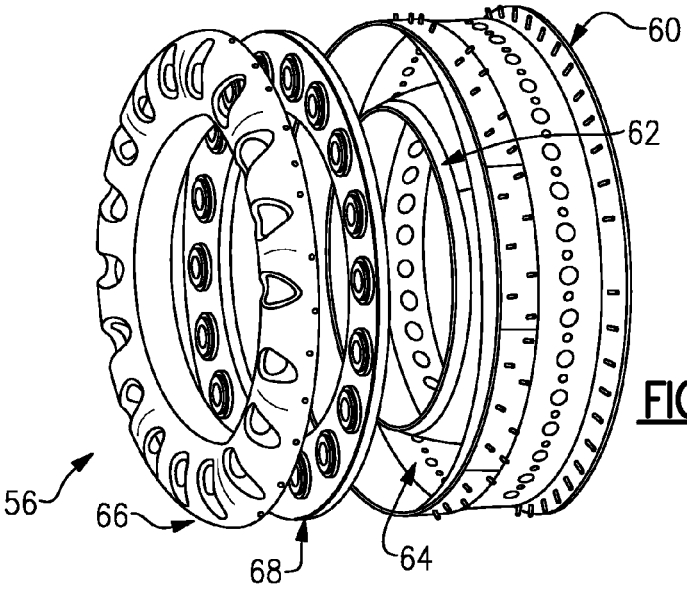
FIG. 2B illustrates an exploded view of an annular combustor.

FIG. 2A shows a perspective, isolated view of the annular combustor 56, and FIG. 2B shows an exploded perspective view of the annular combustor 56. In this example, the annular combustor 56 is generally a 4-piece construction that includes an annular outer shell 60, an annular inner shell 62 that is radially inwardly spaced from the annular outer shell 60 to define an annular combustion chamber 64 there between, an annular hood 66 and a bulkhead 68 that divides the annular combustion chamber 64 and the annular hood 66. The annular combustor 56, and thus the annular outer shell 60, the annular inner shell 62, the annular hood 66 and the bulkhead 68, extends circumferentially around the engine central longitudinal axis A. Thus, the diameters described below are taken with reference to the engine central longitudinal axis A, which is also the central axis of the annular combustor 56.

Figure 3A:
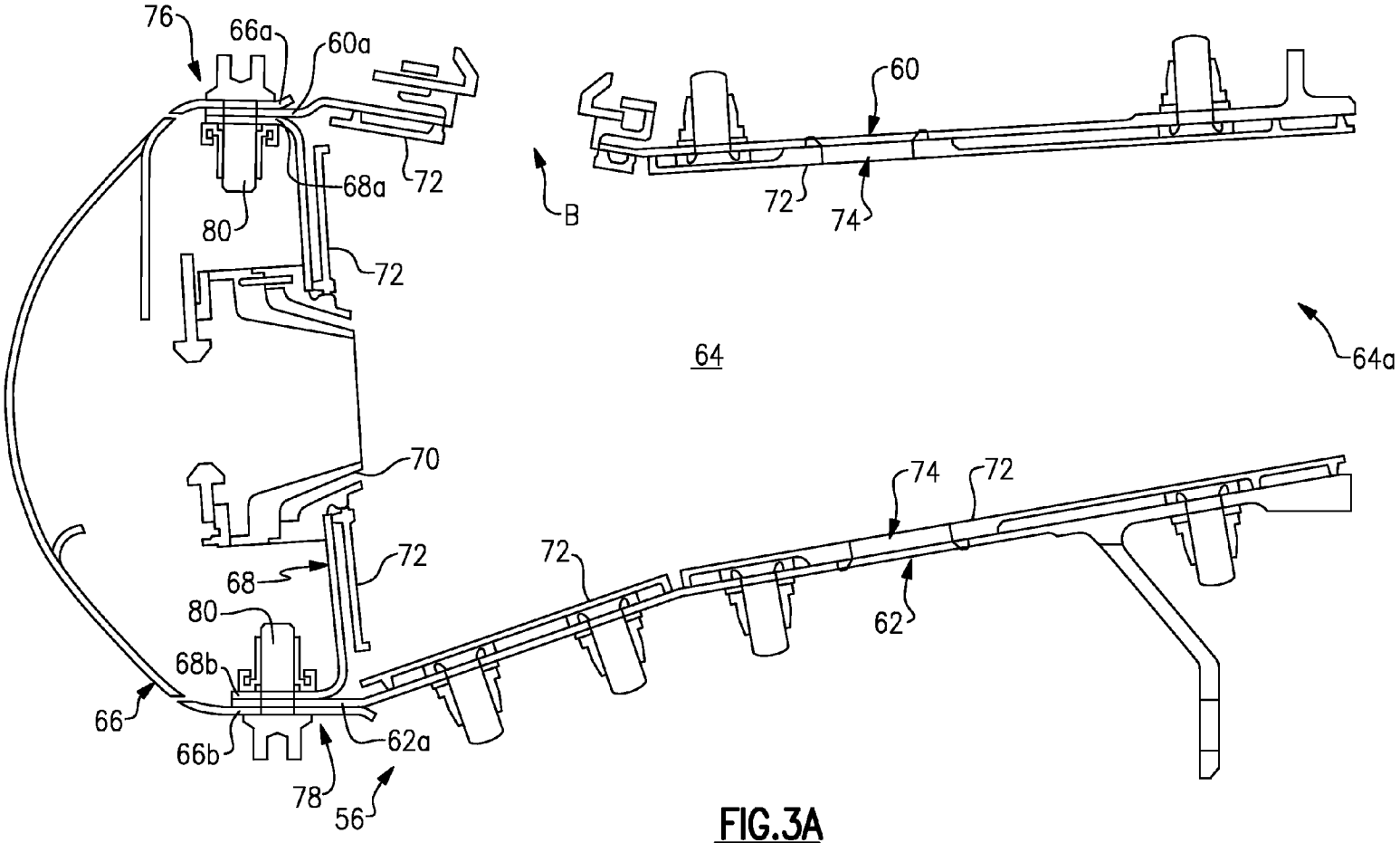
FIG. 3A illustrates a schematic cross-section of selected portions of an annular combustor.

FIG. 3A shows a schematic cross-sectional view of selected locations of the annular combustor 56. As shown, the annular outer shell 60 includes a first flange 60*a*, the annular inner shell includes a second flange 62*a*, and the annular hood 66 includes a radially outer hood flange 66*a* and a radially inner hood flange 66*b*. The bulkhead 68 includes a radially outer bulkhead flange 68*a* and a radially inner bulkhead flange 68*b*.

The annular combustor 56 receives a fuel supply through a fuel nozzle (not shown) and air is provided through a swirler 70. The annular outer shell 60, the annular inner shell 62 and the bulkhead 68 may include heat shield panels 72 for protecting the annular combustor 56 from the relatively high temperatures generated within the annular combustion chamber 64. A flow of hot combustion gases is ejected out of an aft end 64*a* of the annular combustion chamber 64 in a known manner. It is to be understood that relative positional terms, such as "forward," "aft," "upper," "lower," "above," "below," and the like are relative to the normal operational attitude of the gas turbine engine 20 and should not be considered otherwise limiting.

In general, the operating pressure within the annular combustion chamber 64 is lower than the air pressure in the surrounding environment outside of the annular combustor 56. Thus, the pressure differential between the surrounding environment and the annular combustion chamber 64 tends to drive surrounding air into the annular combustion chamber 64. Although controlled inflow of surrounding air, such as through ports 74, is desired to control temperature distribution in the annular combustion chamber 64, uncontrolled leakage of surrounding air into the annular combustion chamber 64 is generally undesirable. Uncontrolled leakage can debit the performance of the annular combustor 56 by altering the combustion stoichiometry, producing variability in the pressure differential and/or generating undesirable emission products, for example.

In the illustrated embodiment, two locations where leakage into the annular combustor 56 can occur are at a radially outer joint 76 and a radially inner joint 78. The joints 76 and 78 are the locations at which, respectively, the annular outer shell 60 and the annular inner shell 62 are secured to the bulkhead 68 and annular hood 66.

As shown in FIG. 3A, the cross-sections of the flanges 60*a*, 66*a*, 68*a*, 62*a*, 66*b* and 68*b* (cross-section taken parallel to the axis A of the engine 20 or annular combustor 56) that are secured at the respective joints 76 and 78 are generally axially oriented. In particular, the axial orientation of the joints 76 and 78 presents a challenge in reducing leakage while maintaining the ability to assemble the joints 76 and 78 together. For example, if there is a relatively loose fit between the flanges 60*a*, 66*a*, 68*a* and the flanges 62*a*, 66*b* and 68*b* at the respective joints 76 and 78, the loose fit would cause an undesirable amount of leakage through gaps in the joints 76 and 78 into the annular combustion chamber 64. On the other hand, if the fit at the joints 76 and 78 were too tight, the flanges 60*a*, 66*a*, 68*a* and the flanges 62*a*, 66*b* and 68*b* at the respective joints 76 and 78 could not be easily assembled together. As will be described below, the joints 76 and 78 disclosed herein are designed to reduce or eliminate leakage while permitting relatively easy assembly.

At the annular outer joint 76 the first flange 60*a* of the annular outer shell 60 is secured between the radially outer hood flange 66*a* and the radially outer bulkhead flange 68*a*. At the radially inner joint 78, the second flange 62*a* of the annular inner shell 62 is secured between the radially inner hood flange 66*b* and the radially inner bulkhead flange 68*b*.

Figure 3B:
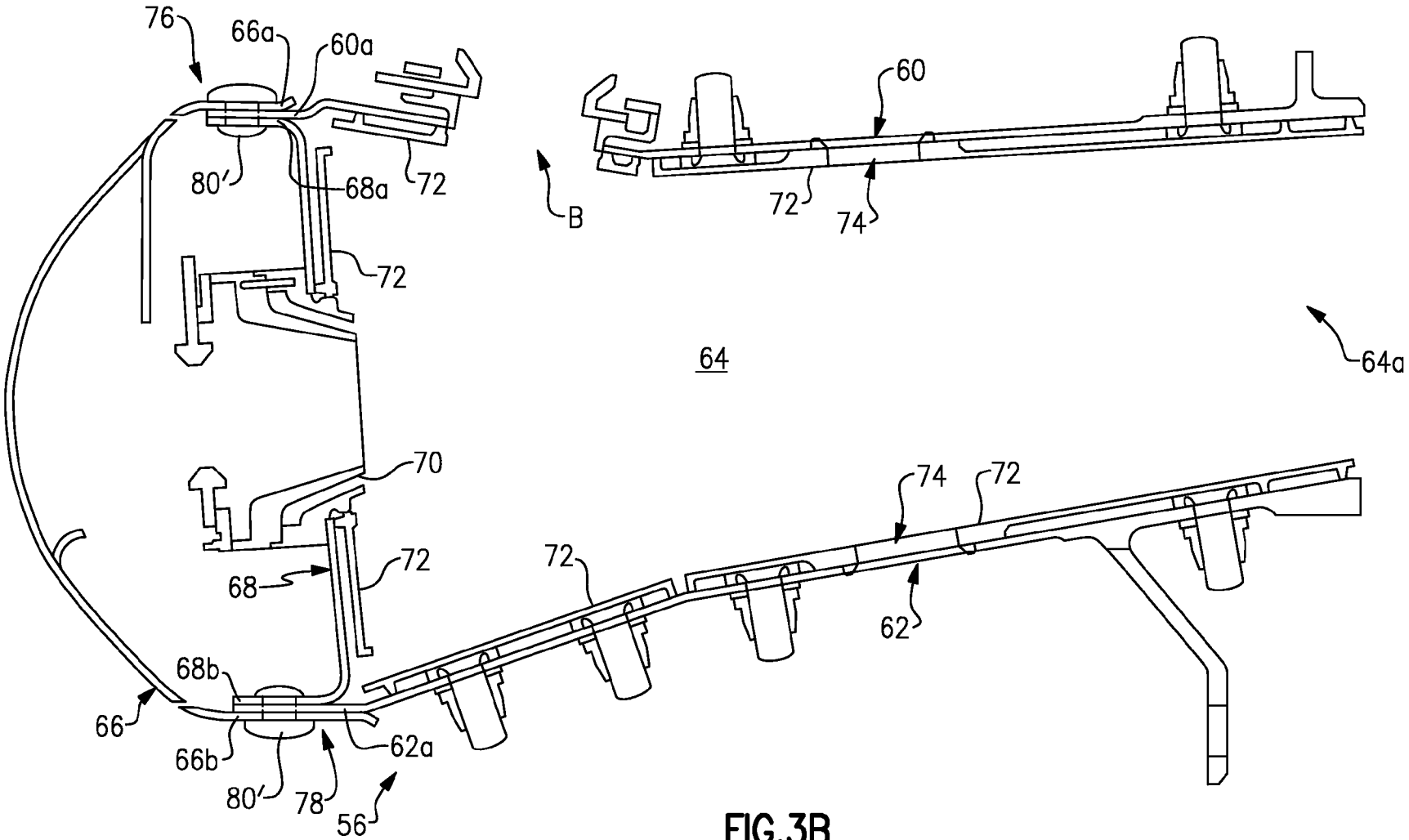
FIG. 3B illustrates a schematic cross-section of selected portions of a modified annular combustor.

In each joint 76 and 78, a respective fastener 80 extends through corresponding aligned openings in the flanges 60*a*, 66*a* and 68*a* and flanges 62*a*, 66*b* and 68*b*. In the example shown in FIG. 3A, the fasteners 80 are threaded bolts. In a modified example shown in FIG. 3B, the fasteners 80' are rivets. Given this description, one of ordinary skill in the art will recognize other suitable fasteners 80 to meet their particular needs.

The diameters of the flanges 60*a*, 66*a*, 68*a*, 62*a*, 66*b* and 68*b* are selected to control leakage through the joints 76 and 78 while still allowing the shells 60 and 62 to be easily assembled with the bulkhead 68 and annular hood 66. As an example, certain diameters are selected with a predetermined relationship, as represented by several ratios, to ensure proper control over the size of the gaps between the flanges 60*a*, 66*a*, 68*a*, 62*a*, 66*b* and 68*b* to control leakage while maintaining the ability to properly assemble the components together.

Figure 4:
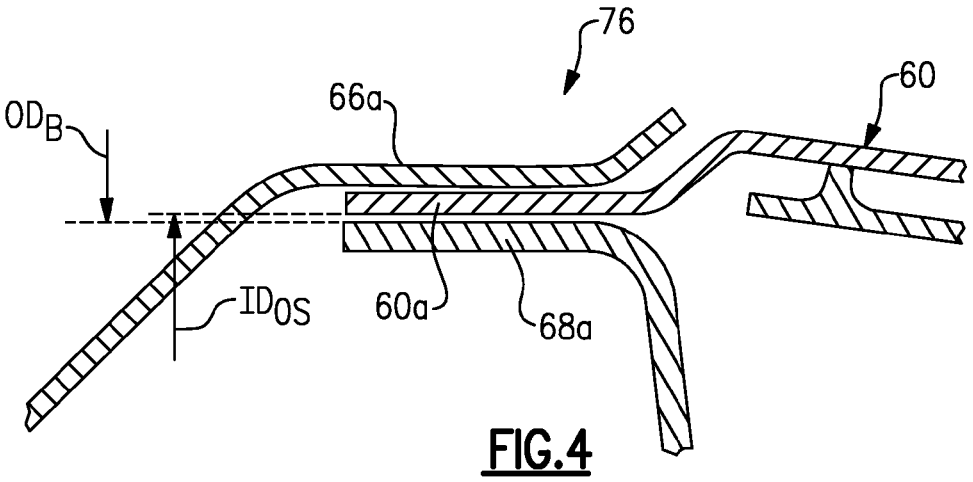
FIG. 4 illustrates selected portions of a radially outer joint of an annular combustor.

FIG. 4 shows expanded views of the radially outer joint 76 of the annular combustor 56. As shown, the first flange 60*a* of the annular outer shell 60 defines an inner diameter $ID_{OS}$ and the radially outer bulkhead flange 68*a* defines and outer diameter $OD_B$. As indicated above, these and other diameters disclosed herein are relative to the central longitudinal axis A of the engine 20. In the radially outer joint 76, the relationship between $ID_O$ and $OD_B$ is preselected to control leakage into the annular combustor 56 at the expected operating temperature of the combustor and expected thermal expansion of the joint 76, while ensuring a proper fit at the joint 76. As an example, the flanges 60*a*, 66*a*, 68*a* are made of a metal alloy, such as a nickel-based alloy. In one non-limiting example, the $ID_{OS}$ and the $OD_B$ define a ratio R1 of $ID_{OS}/OD_B$ that is 0.998622-1.001129. In a further embodiment, R1 is 0.998675-1.001085. In a further example, R1is 0.999177-1.000875. In a further example, the disclosed ratios R1 correspond to different tolerances of the disclosed diameters. In yet a further example, the disclosed ratios R1 correspond to a target nominal leakage area of a gap between the first flange 60*a* of the annular outer shell 60 and the radially outer bulkhead flange 68*a*.

Figure 5:
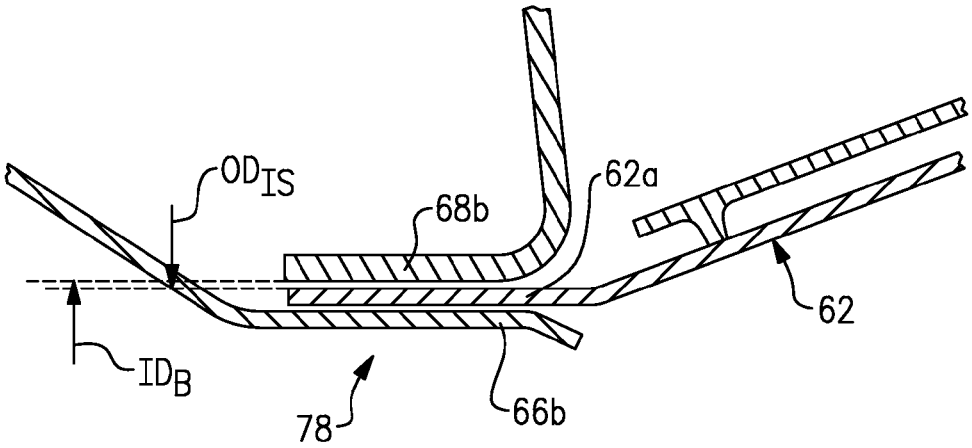
FIG. 5 illustrates selected portions of a radially inner joint of an annular combustor.

FIG. 5 schematically illustrates selected portions of the radially inner joint 78. As shown, the radially inner bulkhead flange 68*b* defines an inner diameter $ID_B$ and the second flange 62*a* of the radially inner shell 62 defines an outside diameter $OD_{IS}$. Similar to the ratio R1, the relationship between the $ID_B$ and the $OD_{IS}$ is preselected to control leakage through the radially inner joint 78 at the expected operating temperature of the combustor and expected thermal expansion of the joint 78, while ensuring a proper fit at the joint 78. As an example, the flanges 62*a*, 66*b* and 68*b* are made of a metal alloy, such as a nickel-based alloy. In one example, a ratio R2 of $ID_B/OD_{IS}$ is 0.998812-1.001388. In a further example, R2 is 0.998859-1.001334. In a further example, R2 is 0.99892-1.000927.

In yet a further example, the disclosed ratios R1 and R2 correspond to a target nominal overall leakage area in the joints 76 and 78 of 0.155 square inches (1 square centimeter) or less, given the above expected operating temperature and materials.

Given the above-disclosed ratios, a method of controlling leakage in the annular combustor 56 includes providing the annular outer shell 60, providing the annular inner shell 62, providing the annular hood 66, providing the bulkhead 68, securing the first flange 60*a* at the radially outer joint 76 with a ratio R1 as described above and securing the second flange 62*a* at the radially inner joint 78 with a ratio R2 as described above. The given ratios are R1 and R2 control leakage of gas through the respective joints 76 and 78.

Figure 6:
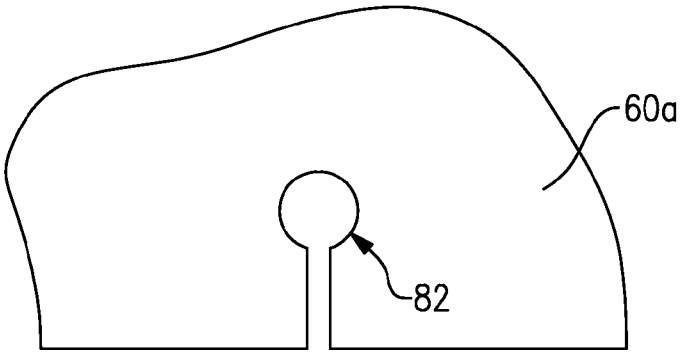
FIG. 6 illustrates a portion of an example flange of a combustor, including a keyhole slot.

Although FIGS. 4 and 5 may exaggerate the dimensions for the purpose of description, due to the close fit in the joints 76 and 78, and depending on the variability in the dimensional tolerances, the flanges 60*a*, 66*a*, 68*a* and the flanges 62*a*, 66*b* and 68*b* may be, force-fit over one another to form the respective joints 76 and 78. In another example, to facilitate assembly, one or more of the annular outer shell 60, annular inner shell 62, bulkhead 68 or annular hood 66 are heated or cooled to thermally expand or contract the component to fit the flanges 60*a*, 66*a*, 68*a*, 62*a*, 66*b* and 68*b* together. In another example, at least the annular outer shell 60 is heated at a temperature of 240° F./116° C. In a further option, at least the annular inner shell 62 is also cooled at a temperature of −275° F./−171° C. In a further option, at least the bulkhead 68 is also heated at a temperature of 350° F./177° C. In another alternative, as shown in FIG. 6, one or more of the flanges 60*a*, 66*a*, 68*a*, 62*a*, 66*b* and 68*b* (flange 60*a* shown as representative) are provided with a plurality of keyhole slots 82 (one shown) extending axially from the free end of the flange 60*a*, 66*a*, 68*a*, 62*a*, 66*b* and 68*b*. The keyhole slots 82 are uniformly spaced around the circumference of the flange 60*a*, 66*a*, 68*a*, 62*a*, 66*b* and 68*b*, for example. The gaps provided by the keyhole slots 82 allow contraction or expansion of the flange 60*a*, 66*a*, 68*a*, 62*a*, 66*b* and 68*b* to facilitate assembly of the joints 76 and 78.

In a further embodiment, the size of the annular hood 66 is selected such that the radially outer hood flange 66*a* forms an interference fit on the first flange 60*a* of the annular outer shell 60. In a further example, the size of annular hood 66 is selected such that the radially inner hood flange 66*b* forms an interference fit with the second flange 62*a* of the annular inner shell 62. The interference fits provide additional leakage control into the annular combustor 56.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure.

The scope of legal protection given to this disclosure can only be determined by studying the following claims.

What is claimed is:

1. An annular combustor comprising:

an annular outer shell including a first flange defining an inner diameter $ID_{OS}$;

an annular inner shell radially spaced from the annular outer shell to define an annular combustion chamber there between, the annular inner shell including a second flange defining an outer diameter $OD_{IS}$;

an annular hood including a radially outer hood flange and a radially inner hood flange; and a bulkhead dividing the annular combustion chamber and the annular hood, the bulkhead including a radially outer bulkhead flange defining an outer diameter $OD_B$ and a radially inner bulkhead flange defining an inner diameter $ID_B$, the first flange being secured in a radially outer joint between the radially outer hood flange and the radially outer bulkhead flange, the second flange being secured in a radially inner joint between the radially inner hood flange and the radially inner bulkhead flange, the $ID_{OS}$ and the $OD_B$ defining a ratio R1 of $ID_{OS}/OD_B$ that is 0.998622-1.001129, and the $ID_B$ and the $OD_{IS}$ defining a ratio R2 of $ID_B/OD_{IS}$ that is 0.998812-1.001388.

2. The annular combustor as recited in claim 1, including an interference fit between the radially outer hood flange and the first flange.

3. The annular combustor as recited in claim 1, including an interference fit between the radially inner hood flange and the second flange.

4. The annular combustor as recited in claim 1, wherein R1 is 0.998675-1.001085.

5. The annular combustor as recited in claim 1, wherein R1 is 0.999177-1.000875.

6. The annular combustor as recited in claim 1, wherein R2 is 0.0.998859-1.001334.

7. The annular combustor as recited in claim 1, wherein R2 is 0.99892-1.000927.

8. A turbine engine comprising:

a compressor section;

an annular combustor in fluid communication with the compressor section; and a turbine section in fluid communication with the annular combustor, the annular combustor comprising:

an annular outer shell including a first flange defining an inner diameter $ID_{OS}$, an annular inner shell radially spaced from the annular outer shell to define an annular combustion chamber there between, the annular inner shell including a second flange defining an outer diameter $OD_{IS}$, an annular hood including a radially outer hood flange and a radially inner hood flange, and a bulkhead dividing the annular combustion chamber and the annular hood, the bulkhead including a radially outer bulkhead flange defining an outer diameter $OD_B$ and a radially inner bulkhead flange defining an inner diameter $ID_B$, the first flange being secured at a radially outer joint between the radially outer hood flange and the radially outer bulkhead flange, the second flange being secured at a radially inner joint between the radially inner hood flange and the radially inner bulkhead flange, the $ID_{OS}$ and the $OD_B$ defining a ratio R1 of $ID_{OS}/OD_B$ that is 0.998622-1.001129, and the $ID_B$ and the $OD_{IS}$ defining a ratio R2 of $ID_B/OD_{IS}$ that is 0.998812-1.001388.

9. A method of controlling leakage in an annular combustor, the method comprising:

providing an annular outer shell including a first flange defining an inner diameter $ID_{OS}$;

providing an annular inner shell radially spaced from the annular outer shell to define an annular combustion chamber there between, the annular inner shell including a second flange defining an outer diameter $OD_{IS}$;

providing an annular hood including a radially outer hood flange and a radially inner hood flange; and providing a bulkhead dividing the annular combustion chamber and the annular hood, the bulkhead including a radially outer bulkhead flange defining an outer diameter $OD_B$ and a radially inner bulkhead flange defining an inner diameter $ID_B$;

securing the first flange at a radially outer joint between the radially outer hood flange and the radially outer bulkhead flange with the $ID_{OS}$ and the $OD_B$ defining a ratio R1 of $ID_{OS}/OD_B$ that is 0.998622-1.001129 to control leakage of gas through the radially outer joint; and securing the second flange at a radially inner joint between the radially inner hood flange and the radially inner bulkhead flange with the $ID_B$ and the $OD_{IS}$ defining a ratio R2 of $ID_B/OD_{IS}$ that is 0.998812-1.001388 to control leakage of gas through the radially inner joint.

10. The method as recited in claim 9, including heating at least one of the annular outer shell, the annular inner shell and the bulkhead at a temperature of at least 240° F./116° C.

11. The method as recited in claim 9, including heating the annular outer shell at a temperature of 240° F./116° C., cooling the annular inner shell at a temperature of −275° F./−171° C., and heating the bulkhead at a temperature of 350° F./177° C.

* * * * *